US006637740B2

(12) United States Patent
Pessina et al.

(10) Patent No.: US 6,637,740 B2
(45) Date of Patent: Oct. 28, 2003

(54) LOADER OF SIGNATURES OR SHEETS FOR BOOKBINDERY FEEDER

(75) Inventors: Giorgio Pessina, Cusano Milanino (IT); Aldo Perobelli, Paderno Dugnano (IT)

(73) Assignee: O.M.G. di Giorgio Pessina e Aldo Perobelli s.n.c., Milan (IT)

( * ) Notice: Subject to any disclaimer, the term of this patent is extended or adjusted under 35 U.S.C. 154(b) by 0 days.

(21) Appl. No.: 10/023,358

(22) Filed: Dec. 17, 2001

(65) Prior Publication Data

US 2002/0079635 A1 Jun. 27, 2002

(30) Foreign Application Priority Data

Dec. 22, 2000 (IT) ..... MI00A2829

(51) Int. Cl.[7] ..... B65H 5/22
(52) U.S. Cl. ..... 271/3.03; 271/3.06; 271/3.13
(58) Field of Search ..... 271/3.01, 3.03, 271/3.05, 3.06, 3.13, 176, 157, 163, 151

(56) References Cited

U.S. PATENT DOCUMENTS 3,690,650 A * 9/1972 Maier, Jr. et al.
3,904,191 A * 9/1975 Maier, Jr. et al.
4,008,890 A * 2/1977 Pulda
4,783,065 A * 11/1988 Graves, Sr.
4,911,421 A * 3/1990 Hannon
5,282,613 A * 2/1994 Standerfer et al.
5,342,036 A * 8/1994 Golicz
6,017,028 A * 1/2000 St. John et al.
6,086,061 A * 7/2000 Vedoy et al.
6,220,590 B1 * 4/2001 Bates et al.

FOREIGN PATENT DOCUMENTS

JP 3-256976 A * 11/1991
JP 4-125237 A * 4/1992

* cited by examiner

*Primary Examiner*—David H. Bollinger
(74) *Attorney, Agent, or Firm*—Dann, Dorfman, Herrell and Skillman; Henry H. Skillman

(57) ABSTRACT

Loader of signatures or sheets with scale-shaped arrangement comprising a retractable plane (10) onto which a small stack (7) of signatures or sheets (3) is deposited, which is unloaded onto the plane (2') of a feeder (2) after the retractable plane (10) has moved back. The latter is located at a minimum difference in height relative to the horizontal upper part (5') of a conveyor belt (5) of the signatures or sheets (3) coming from the loader (1) and at a short distance from the plane (2') of the feeder (2).

5 Claims, 2 Drawing Sheets

LOADER OF SIGNATURES OR SHEETS FOR BOOKBINDERY FEEDER

The present invention pertains to a loader of signatures or sheets with scale-shaped (imbricated) arrangement which are deposited onto the plane of a bookbindery feeder.

According to the prior art, known loaders for signatures or sheets of this type have a limited use, since they present a difficulty when they are positioned on the side where bookbindery feeders have their separation and grasping mechanisms for signatures and sheets. This difficulty is due to the fact that signatures or sheets to be fed, arranged in a scaled fashion on the loader, must fall from a considerable height, thereby disarranging, to be deposited onto the feeder's plane, which creates operational problems. This is due to the fact that the loader must be positioned at such a height as not to interfere with the feeder's mechanisms. The feeder works properly without frequent stops when the stack of signatures or sheets on the withdrawal plane is low, since signatures or sheets are taken out of the lower part of the stack. A tall stack on the feeder weighs heavily upon the lower signature or sheet which is grasped by the feeder's mechanisms, thereby creating operational difficulties. Aim of the present invention is to solve the above mentioned problems, as will be detailed in the following description, which is merely exemplary and not limiting, and illustrated in the attached drawings, in which:

Figure 1:
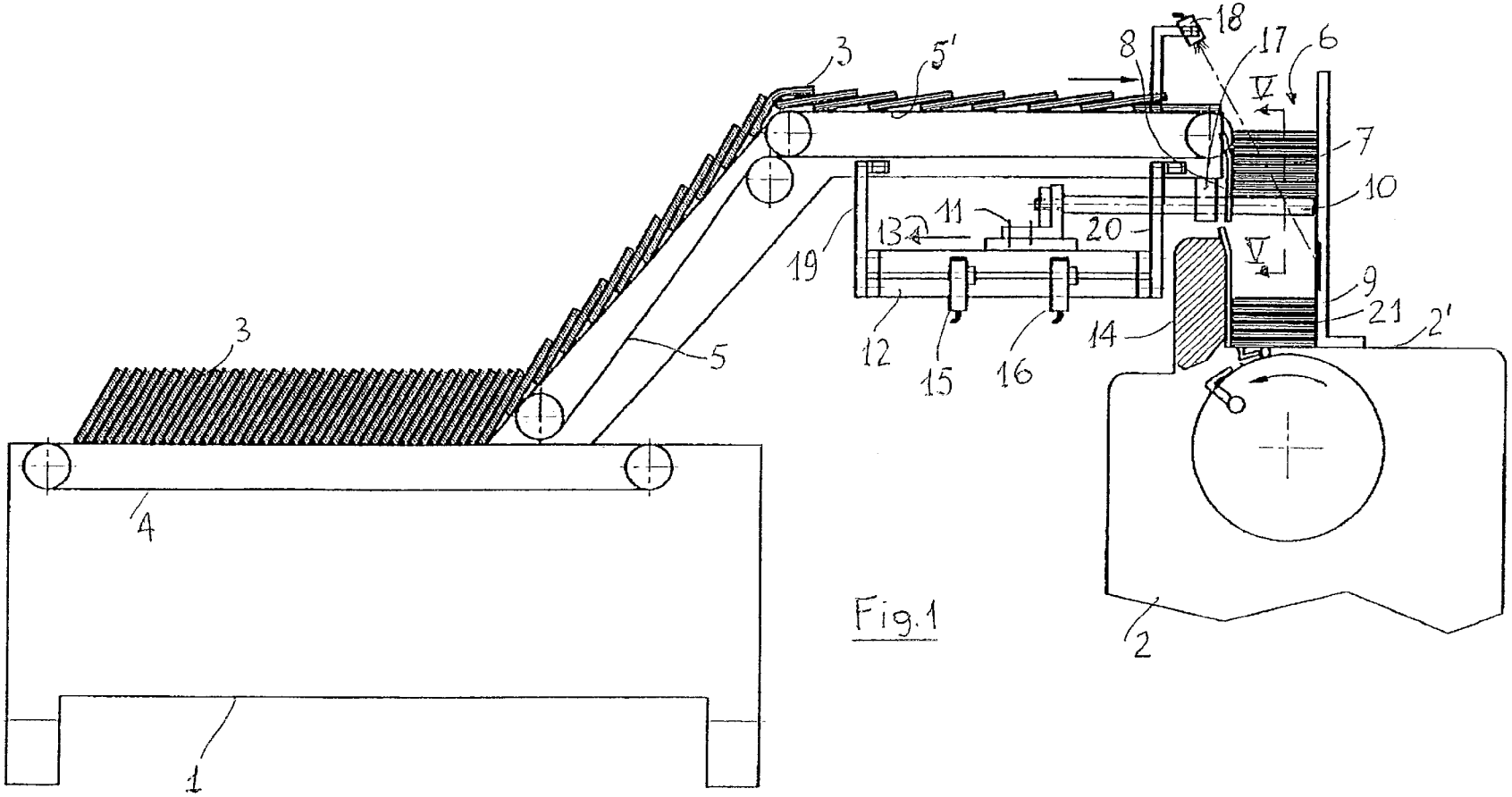
FIG. 1 represents a schematic view of the loader-feeder unit.

In FIG. 1, a loader 1 and a feeder 2 are schematically represented. On the flat part of the loader 1 signatures or sheets 3 are arranged vertically and conveyed by conveyor belts 4. Upon contact with the elevator belts 5, for signatures or sheets 3 arrange themselves as scales until they come close to a stacking basket 6 with the horizontal upper part 5' of belt 5.

Figures 2, 3, 4, 5:
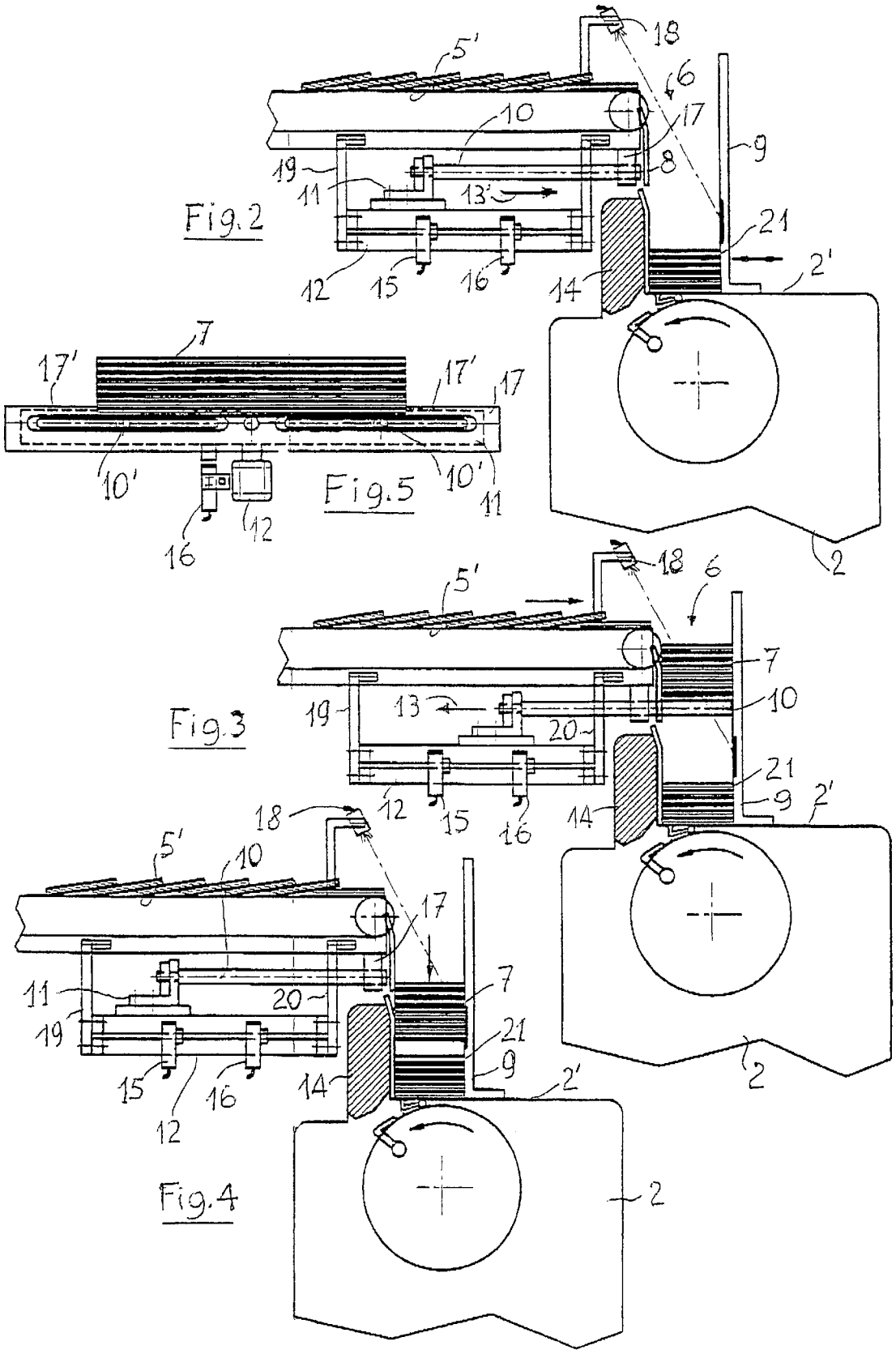
FIGS. 2, 3, 4 represent the various stages of the mechanism object of the invention, connecting the loader to the feeder.
FIG. 5 is a cross-section according to line V—V— of FIG. 1.

In the basket, the signatures or sheets form a small stack 7 which is held in its correct position by means of vertical shoulders 8 and 9 and supported by a retractable plane 10 made up of the shoulders 10' which can be seen in FIG. 5. One shoulder or both shoulders 8 and 9 can be adjusted according to the size of the signatures or sheets 3. The retractable plane 10 with its shoulders 10', at a minimum difference in height from 5', is connected by means of a member 11 to a preferably rodless piston 12, which moves according to arrow 13 and causes the stack of signatures or sheets 7 to fall onto the plane 2' of the feeder 2. Through this system a small stack 7 of signatures or sheets can be fed into the feeder 2, and signatures or sheets are correctly positioned on the withdrawal plane 2' of the feeder 2. At the same time the mechanisms of the feeder 2, contained in the shaded area 14 of FIGS. 1, 2, 3, and 4 on the loader's side 1 are bypassed. The piston 12 is equipped with sensors 15 and 16 to allow the adjustment of shoulders' 10' stroke according to the size of signatures or sheets 3 and the end-of-stroke control of said shoulders, respectively. Shoulders 10' are preferably adjustable according to the size of signatures or sheets 3, as will be described hereinafter. Such shoulders 10' are supported by the member 11 and by the prismatic member 17 having grooves 17' to allow adjustment when shoulders 10' move, as illustrated in FIG. 5. Such movement takes place in either direction along said grooves placing shoulders 10' in positions suitable to support signatures or sheets according to their size.

The level sensor 18, which detects the lack of a stack or the presence of a stack of signatures or sheets which is too low, is fixed to the upper part of the loader 1.

The mechanism object of the invention, which comprises shoulders 10' and means suitable to move them, is fixed to the structure of the loader 1 through rods 19 and 20.

The operating sequence of said mechanism connecting loader and feeder is described hereinafter:

the level sensor 18 (FIG. 2), upon detecting the lack of a stack or the presence of a stack of signatures or sheets 21 which is too low on the plane 2' of the feeder 2, causes the piston 12 connected to the retractable plane 10 with shoulders 10' to move in the direction of arrow 13'. The sensor 16 stops the stroke of piston 12 in the position shown in FIG. 3 and in FIG. 1, at a short distance from plane 2'. After shoulders 10' have stopped in the position of FIG. 3 and FIG. 1, conveyor belts 4 and elevator belts 5 feed scale-arranged signatures or sheets 3 to form a small stack 7 that is well aligned in the stacking basket 6.

When the stack 7 is complete, for example after a time period measured by means of a timer, not shown in the figures, the shoulders 10' reach the retracted position shown in FIG. 4, intercepting the position sensor 15, which adjusts the shoulders' 10' stroke according to the size of signatures or sheets 3. Thus the small stack 7 of signatures or sheets goes down correctly, without disarranging, onto the plane 2' of the feeder 2 or onto the portion of stack 21 lying on the feeder 2. Shoulders 10' remain in the retracted position of FIG. 4 until level sensor 18 detects a lowering of the stack 7 of signatures or sheets, due to the fact that signatures or sheets are removed by the feeder from the lower part of stack 21 (FIG. 4). At this point, the loading sequence is resumed with shoulders 10' moving in the direction of arrow 13' (FIG. 2).

The movement of shoulders 10' can also be performed with equivalent means, such as belts, chains, motor-driven racks or racks driven by hydraulic pistons or similar means.

The present invention can undergo practical changes without however departing from the scope of the present invention, as hereinafter claimed.

What is claimed is:

1. A loader of signatures or sheets (3) with scale-shaped arrangement to be deposited onto the plane (2') of a bookbindery feeder (2), characterized in that it comprises a retractable plane (10) onto which a stack (7) of signatures or sheets (3) is deposited which lies at a minimum difference in height relative to the horizontal upper part (5) of a conveyer belt (5) for signatures or sheets (3) with scale-shaped arrangement, so that as a result the stack (7) on the retractable plane (10) is low, and which is located at a short distance from the plane (2') of the feeder (2) and offset from the mechanisms (14) of the feeder (2) which is then downloaded onto the plane (2') of the feeder (2) after the retractable plans (1) has moved back, and a level sensor (18) which detects the lack of a stack or the presence of a stack which is too low (21) on the plane (2') of the feeder (2) and causes the retractable plane (10) to move into the path of the signatures or sheets (7) as they fall from the conveyor (5) so that a small stack (7) thereof will be loaded onto the retractable plane (10).

2. A loader according to claim 1, characterized in that it comprises a means which interrupts the loading of said small stack (7) as soon as this has reached a set height and causes the retractable plane (10) to move back out of their path.

3. A loader according to claim 2, characterized in that said means is a timer.

4. A loader according to claim 1, characterized in that the movements of the retractable plane (10) are driven by driving means consisting essentially of a piston (12) equipped with sensors (16, 15) to check the end of stroke of the retractable plane (10) and to adjust the degree of movement of the retractable plane (10) according to the size of signatures or sheets (3).

5. A loader according to claim 1, characterized in that the retractable plane (10) has portions (10') which are caused to slide and positioned in grooves (17') on a support (17) integral with the loader (1).

* * * * *

UNITED STATES PATENT AND TRADEMARK OFFICE

CERTIFICATE OF CORRECTION

PATENT NO. : 6,637,740 B2
DATED : October 28, 2003
INVENTOR(S) : Pessina et al.

It is certified that error appears in the above-identified patent and that said Letters Patent is hereby corrected as shown below:

Column 2,
Line 51, “part (5)” should be -- part (5’) --;
Line 58, “plans” should be -- plane --.

Signed and Sealed this

Twenty-third Day of December, 2003

JAMES E. ROGAN
*Director of the United States Patent and Trademark Office*